US005979388A

United States Patent [19]

Akagi et al.

[11] Patent Number: 5,979,388

[45] Date of Patent: Nov. 9, 1999

[54] STARTING CONTROL VALVE ASSEMBLY FOR MULTIPLE THROTTLE

[75] Inventors: Takashi Akagi; Toshiyuki Kubota, both of Saitama, Japan

[73] Assignee: Honda Giken Kogyo Kabushiki Kaisha, Tokyo, Japan

[21] Appl. No.: 09/118,825

[22] Filed: Jul. 20, 1998

[30] Foreign Application Priority Data

Sep. 24, 1997 [JP] Japan ..... 9-259121

[51] Int. Cl.[6] ..... F02N 17/00

[52] U.S. Cl. ..... 123/179.18; 123/59.5

[58] Field of Search ..... 123/179.16, 179.15, 123/179.14, 336, 339.24, 339.25, 339.26, 179.18, 59.5, 339.13, 580

[56] References Cited

U.S. PATENT DOCUMENTS 3,030,819 4/1962 Edelbrock, Jr. ..... 123/59.5
4,018,199 4/1977 Furucz ..... 123/59.5
4,205,641 6/1980 Yamasaki et al. ..... 123/179.15
4,319,553 3/1982 Endo ..... 123/59.5
4,682,576 7/1987 Nakamura et al. ..... 123/179.18
5,181,491 1/1993 Izumi et al. ..... 123/336
5,827,335 10/1998 Ward ..... 123/336

*Primary Examiner*—John Kwon
*Attorney, Agent, or Firm*—Birch, Stewart, Kolasch & Birch, LLP.

[57] ABSTRACT

Bypass tubes connected to intake ports of each throttle body are connected to joint pipes of a starting control valve assembly. The starting control valve assembly includes valve bodies having communication paths formed therein. The communication paths communicate with an air cleaner. First and second flow paths connect the communication paths and the joint pipes. Tuning screws are provided for adjusting the opening amount of each of the first flow paths and a shaft valve is rotatably mounted in through holes which are orthogonal to the second flow paths for collectively adjusting the opening amount of the second flow paths. Furthermore, a plurality of idle connection holes are provided in the shaft valve which all face in the same direction.

18 Claims, 7 Drawing Sheets

STARTING CONTROL VALVE ASSEMBLY FOR MULTIPLE THROTTLE

BACKGROUND OF THE INVENTION

1. Field of the Invention

This invention relates to a starting control valve assembly in a multiple throttle of a multiple cylinder engine for a vehicle such as a motorcycle.

2. Description of Related Art

In a multiple throttle valve body of a multiple cylinder engine for a motorcycle, etc., as shown in FIG. 6 and FIG. 7, a starter valve 3 is provided for each throttle body 1, and the inside of an air cleaner 4 is connected through these starter valves 3 to intake ports 5 of throttle bodies 1.

The starter valve 3 is formed in the throttle body 1, and has tuning screws 3*a*, 3*b* provided midway along a flow path connected to the intake port 5. Valves provided on the tips of the tuning screws 3*a* are moved by rotating the tuning screws 3*a*. One of the tuning screws 3*b* constitutes a reference among the tuning screws 3*a*, 3*b*. Adjustment of the degree of idle opening between each cylinder is carried out by adjusting the degree of opening of the flow paths, and adjusting the amount of intake from the air cleaner 4.

Furthermore, the starter valves 3 are provided with lever plates 6 respectively engaged with the tuning screws 3*a*, 3*b*. The lever plates 6 are attached to a support shaft 7 which is supported rotatably and urged by a spring 8. A wire drawn from a choke is connected to one of the lever plates 6. When the engine is started, the lever plate 6 is rotated backwards against the force of the spring 8. The axis of the support shaft 7 acts as a center, by pulling the wire. In this way, each of the tuning screws 3*a*, 3*b* of each of the starter valves 3 are collectively rotated towards the rear, and the intake amount of the intake ports 5 is increased.

When the intake amount is increased at start up, the above described starter valves 3 are simultaneously rotated towards the rear. Therefore, there is a need for a connecting structure so that the tuning screws of each of the starter valves 3 can slide together. This increases the number of components and brings about an increase in the cost.

Also, there is a simple structure for distributing air from one valve to the intake ports of each throttle body at the time of idling and start up. However, in this case, competition for air supply occurs between the cylinders which causes a usage limitation and a uniform amount of air can not be supplied.

SUMMARY OF THE INVENTION

The present invention has been conceived in view of the above described problems. An object of the present invention is to provide a starting control valve assembly for a multiple throttle capable of simplifying the structure of a throttle body and reducing cost. Furthermore, an object of the present invention is to make adjustment of the idle opening between cylinders of each throttle body easier.

In order to achieve the above described object, a starting control valve assembly for a multiple throttle with multiple throttle bodies according to a first embodiment of the present invention includes intake ports for introducing a mixture to each combustion chamber of a multiple cylinder engine and for supplying air from an air cleaner to the intake paths via a bypass channel. The starting control assembly comprises valve bodies having supply paths with one end connected to each throttle body and respective other ends connected to the intake ports; connection paths, formed in the valve bodies, connected to the air cleaner; first flow paths and second flow paths for connecting the connection paths and the supply paths; adjustment screws, respectively provided in the first flow paths, for adjusting respective open amounts of the first flow paths; and rod like shaft valves rotatably provided within through holes crossing respective second flow paths. A plurality of idle connection holes respectively connected to the second flow paths are formed in the shaft valves, facing in the same direction. Furthermore, the opening extents of the second flow paths are adjusted together using the idle connection holes, by causing the shaft valves to rotate.

Furthermore, idle adjustment and increase in the intake amount when starting the engine for each throttle can be carried out collectively by one shaft valve provided in the valve body.

A starting control valve assembly for a multiple throttle according to a second embodiment of the present invention is substantially the same as the starting control valve assembly for a multiple throttle according to the first embodiment. However, seal members are provided in the shaft valves at positions interposed between the second flow paths, and each second flow path is made airtight. In this way, it is possible to prevent leaks between each second flow path 2.

A starting control valve assembly for a multiple throttle according to a third embodiment of the present invention is substantially the same as the starting control valve assembly for a multiple throttle according to the first or second embodiments. However, control motors are provided in the shaft valves, and the shaft valves are rotatably adjusted using the control motors. In this way, the engine idle opening amount and increase in air intake amount when starting the engine can be electrically controlled very easily by the control motors.

A starting control valve assembly for a multiple throttle according to a fourth embodiment of the present invention is substantially the same as the first and second embodiments. However, a displacement device has rods connected to the shaft valves. The rods are moved in response temperature variations, and therefore the shaft valves are adjusted by the displacement device. In this way, by having the displacement device operate, for example, due to variations in temperature of the coolant, the shaft valves are rotated according to variations in engine temperature and it is possible to increase the idle opening amount and amount of intake when starting the engine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Embodiments of a starting control valve assembly for a multiple throttle of the present invention will now be described below with reference to the accompanying drawings.

Figure 1:
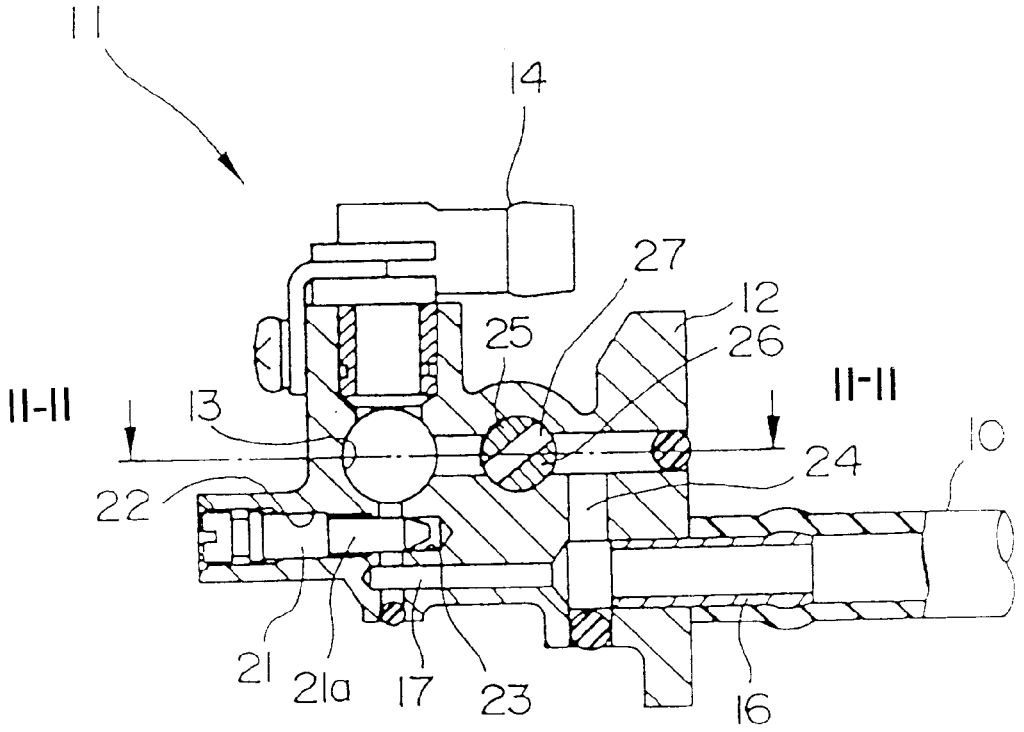
FIG. 1 is a cross sectional view of a starting control valve assembly which illustrates the composition and structure of a starting control valve assembly for a multiple throttle of a first embodiment of the present invention.
Figure 2:
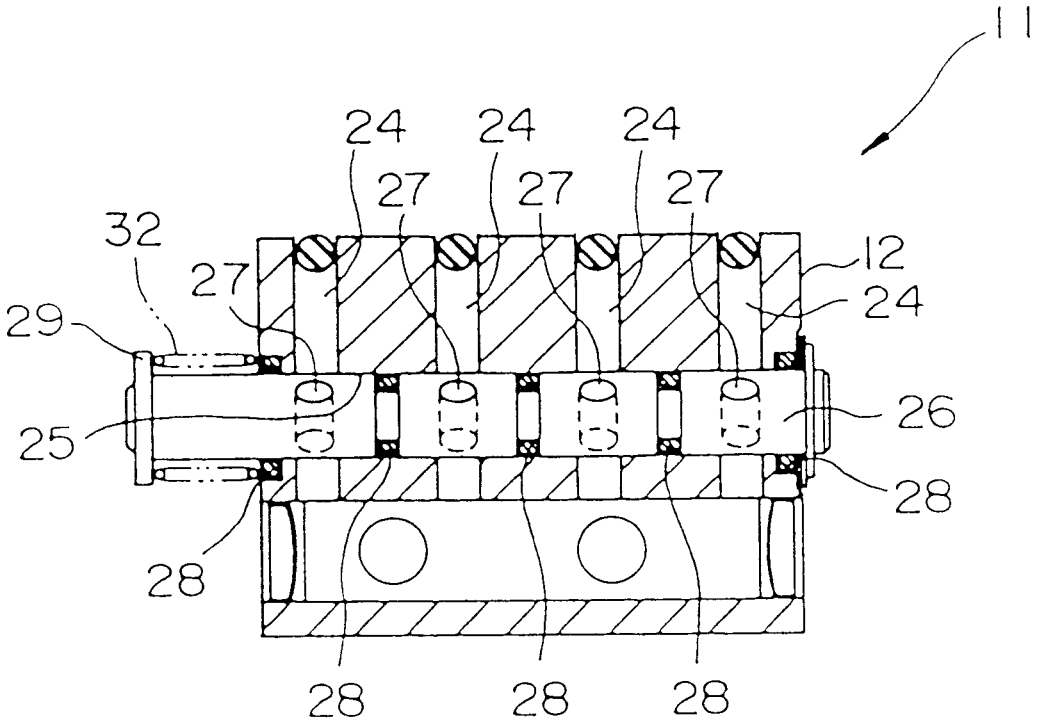
FIG. 2 is a cross sectional view taken along line II—II in FIG. 1 of a starting control valve assembly which illustrates the composition and structure of a starting control valve assembly for a multiple throttle of the fist embodiment of the present invention.
Figure 3:
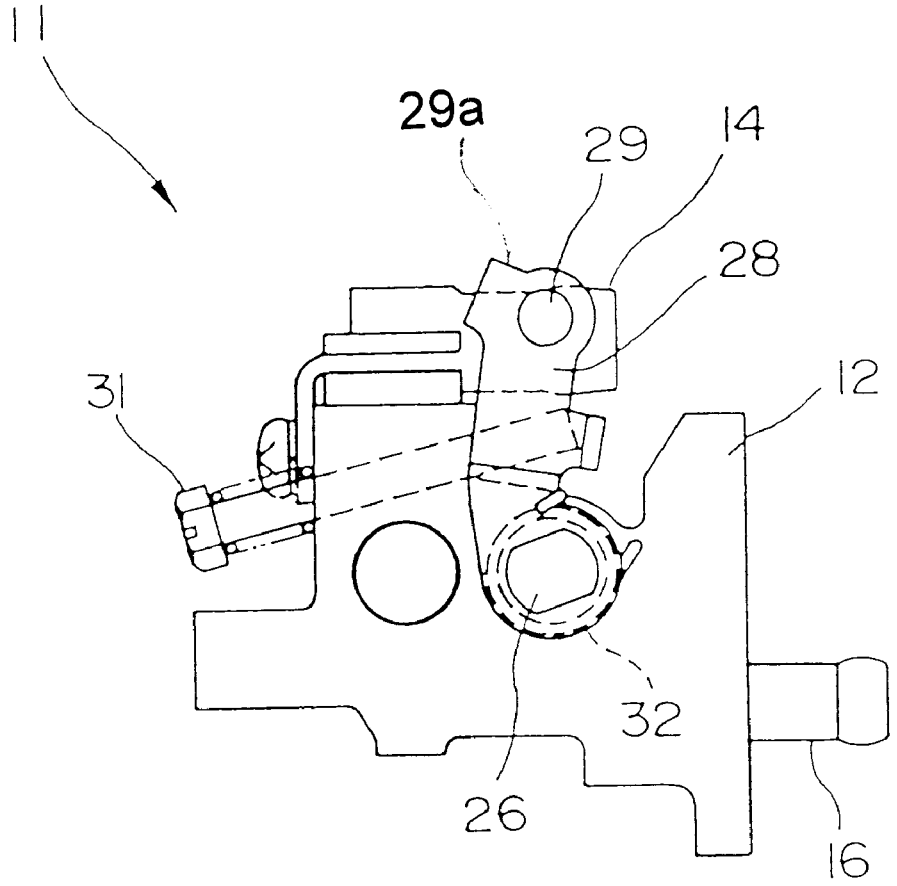
FIG. 3 is a side view of a starting control valve assembly which illustrates the composition and structure of a starting control valve assembly for a multiple throttle of the first embodiment of the present invention.

In FIG. 1 to FIG. 3, reference numeral 11 is a starting control valve assembly provided in a multiple throttle body of a motorcycle, etc. Bypass tubes 10, connected to each throttle body, and communicating with the intake ports of each throttle body, are connected to the starting control valve assembly 11.

Communication paths 13 are formed in the valve bodies 12 along the width direction thereof. Air introduction ports 14 are provided above the valve bodies 12. Pipes (not shown), connected to the air cleaner are connected to the air introduction ports 14, and air is supplied to the communication paths 13 through the introduction ports 14.

Joint pipes 16, connected to the bypass tubes 10, are also provided in the valve bodies 12. The inside of the joint pipes 16 and the communication paths 13 are connected together through first flow paths 17, formed for each cylinder, and second flow paths 24. The joint pipes 16 are supply paths for supplying air to each throttle body.

Tuning screws 21 are provided midway along the first flow paths 17. The tuning screws 21 are screwed into screw holes 22 formed in the valve bodies 12. Tip parts 21*a* of the tuning screws 21 are also inserted into holes 23 crossing the flow paths 17. The extent to which the screws are screwed in when the tuning screws 21 are rotated changes. Therefore, the opening amounts of the first flow paths 17 are adjusted by adjusting the extent to which the tip parts 21*a* are inserted into the holes 23.

That is, the amount of intake air supplied from the air cleaner to the intake port of each throttle body through the valve bodies 12 and the bypass tubes 10 is adjusted by rotating the tuning screws 21.

Furthermore, through holes 25 are formed in the valve bodies 12, crossing and communicating with the second flow paths 24. A rod-like shaft valve 26 is rotatably provided in the through hole 25.

Idle communication holes 27, being the same in number as the number of cylinders, are formed in the shaft valves 26, in the same direction and orthogonal to the shaft. Seal members 28 are also provided on both sides of the shaft valve 26 sandwiching the second flow paths 24. Each of the second flow paths 24 are therefore made airtight.

By rotating the shaft valve 26 to establish a path between the communication holes 27 formed in the shaft valve 26 and the second flow paths 24, a path is set up between the communication paths 13 connecting to the air cleaner and the joint pipes 16 connecting to the intake ports of the throttle bodies through the bypass tubes 10. Air is thus supplied from the air cleaner to the intake ports of each throttle body through the valve bodies 12 and the bypass tubes 10.

A lever 29 is also provided on the end of the shaft valve 26. A wire attachment portion 29*a* is formed on the end of the lever 29, and an end of a wire (not shown) drawn from a choke lever (also not shown) is connected to the wire attachment portion 29*a*.

Idle screws 31 are also provided in the valve bodies 12. A tip of each idle screw 31 regulates movement of a the lever 29 in one direction by coming into contact with part of the lever 29. A regulated position of rotation of the lever 29 can also be adjusted by adjusting the extent to which the idle screws 31 are screwed in. Springs 32 are also provided on the shaft valve 26, to urge the shaft valve 26 in a direction which brings the lever 29 into contact with the idle screws. The shaft valve 26 is urged by the springs 32, and the lever 29 provided on the shaft valve 26 is brought into contact with the idle screws 31.

If the extent to which the idle screws are screwed in is caused to fluctuate, the shaft valve 26 rotates and the amount of communication between the communication holes 27 of the shaft valve 26 and the second flow paths 24; namely, the idle opening amount for each throttle, is collectively adjusted.

If the wire connected to the wire attachment portion 29*a* is pulled, the lever 29 is rotated in the reverse direction, against the force of the spring 32, to rotate the shaft valve 26. In this way, the communication holes 27 of the shaft valve 26 and the second flow paths 24 are collectively connected, the opening amount is increased, and the amount of intake air to the intake ports of each throttle body is increased.

Specifically, the starting control valve assembly 11 can carry out favorable engine starting through an increased amount of air intake to each intake port, by pulling the wire connected to the lever 29.

Furthermore, extremely easy adjustment of the idle opening amount for each throttle can be performed by rotating the idle screws 31. By carrying out rotational adjustment of the tuning screws 21 for other throttles in accordance with a throttle which constitutes a reference, it is possible to carry out simple adjustment of the idle opening amounts between cylinders for all of the throttles.

In this way, the starting control valve assembly 11 of the above described embodiment has the tuning screws 21 provided for each cylinder together in a single valve body 12. Because the valve body 12 and each throttle body are connected through bypass tubes 10, the direction in which the tuning screws 21 face can be freely chosen, compared to the structure of the related art in which the tuning screws 21 are respectively provided in each throttle body, without being restricted by the position at which the throttle body is arranged. Furthermore, excellent layout design freedom is possible making it possible to utilize space efficiently.

Therefore, by using the starting control valve assembly 11 having the starter tuning screws 21 provided together in the valve bodies 12, adjustment of the idle opening amount after being mounted in a motorcycle etc. can be carried out extremely easily from one side. Furthermore, it is possible to reduce the time and effort required for vehicle maintenance.

It is also possible to reduce the manufactured length of the flow path of the throttle body and the complexity of its shape. In this way, the manufacturing cost of the throttle body can be reduced.

Using a single shaft valve 26 provided in the valve bodies 12, it is possible to collectively carry out idle adjustment for each throttle as well as increase the air intake amount at the time of starting. Furthermore, compared to the structure of the related art in which a multiple piston type starter valve is provided for each throttle body, the number of component parts can be substantially reduced, and the cost can be drastically reduced.

In addition, since air is respectively supplied to the intake ports of each throttle body when idling and when starting through the second flow paths 24, no competition for air supply occurs between the cylinders, and it is possible to ensure stable idling.

Also, seal members 28 are provided on the shaft valve 26 sandwiching the second flow paths 24, which means that it is possible to prevent leakage from the second flow paths 24.

Figure 4:
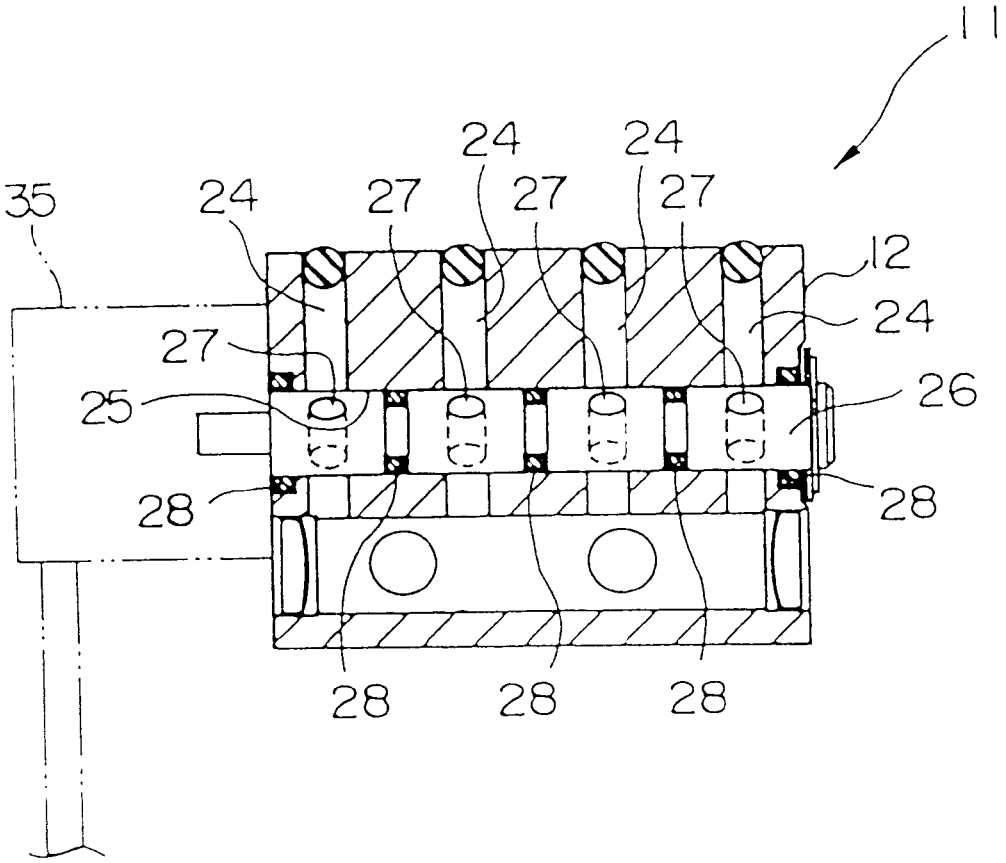
FIG. 4 is a cross sectional view along line II—II in FIG. 1 which illustrates the composition and structure of a starting control valve assembly for a multiple throttle of a second embodiment of the present invention.

FIG. 4 shows a starting control valve assembly 11 having a control motor 35 connected to the end of the shaft valve 26. In this case, rotation of the shaft valve 26 is achieved through use of the control motor 35. The starting control valve assembly 11 engine idling open adjustment and fluctuation in intake at the time of starting can be electrically controlled by the control motor 35.

Figure 5:
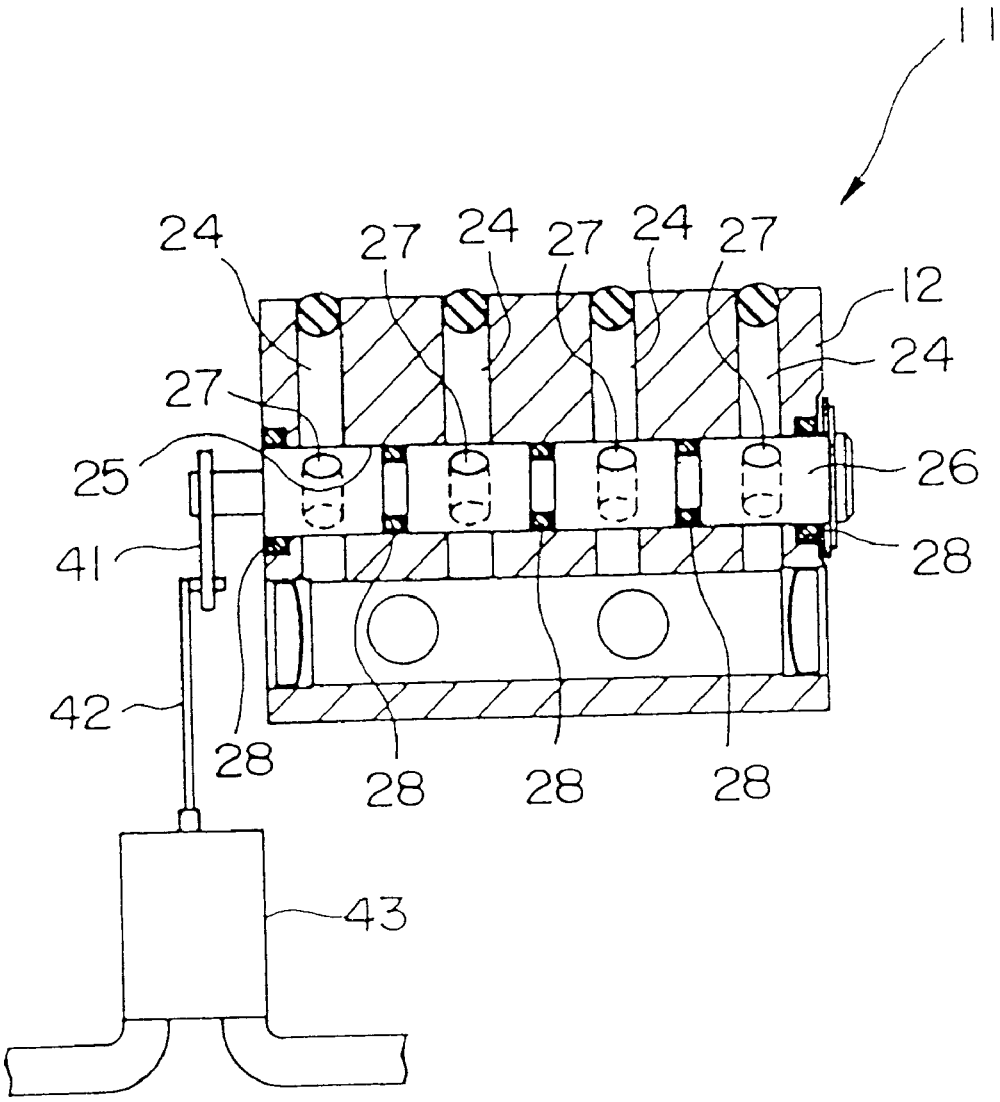
FIG. 5 is a cross sectional view along line II—II in FIG. 1 which illustrates the composition and structure of a starting control valve assembly for a multiple throttle of a third embodiment of the present invention.
Figure 6:
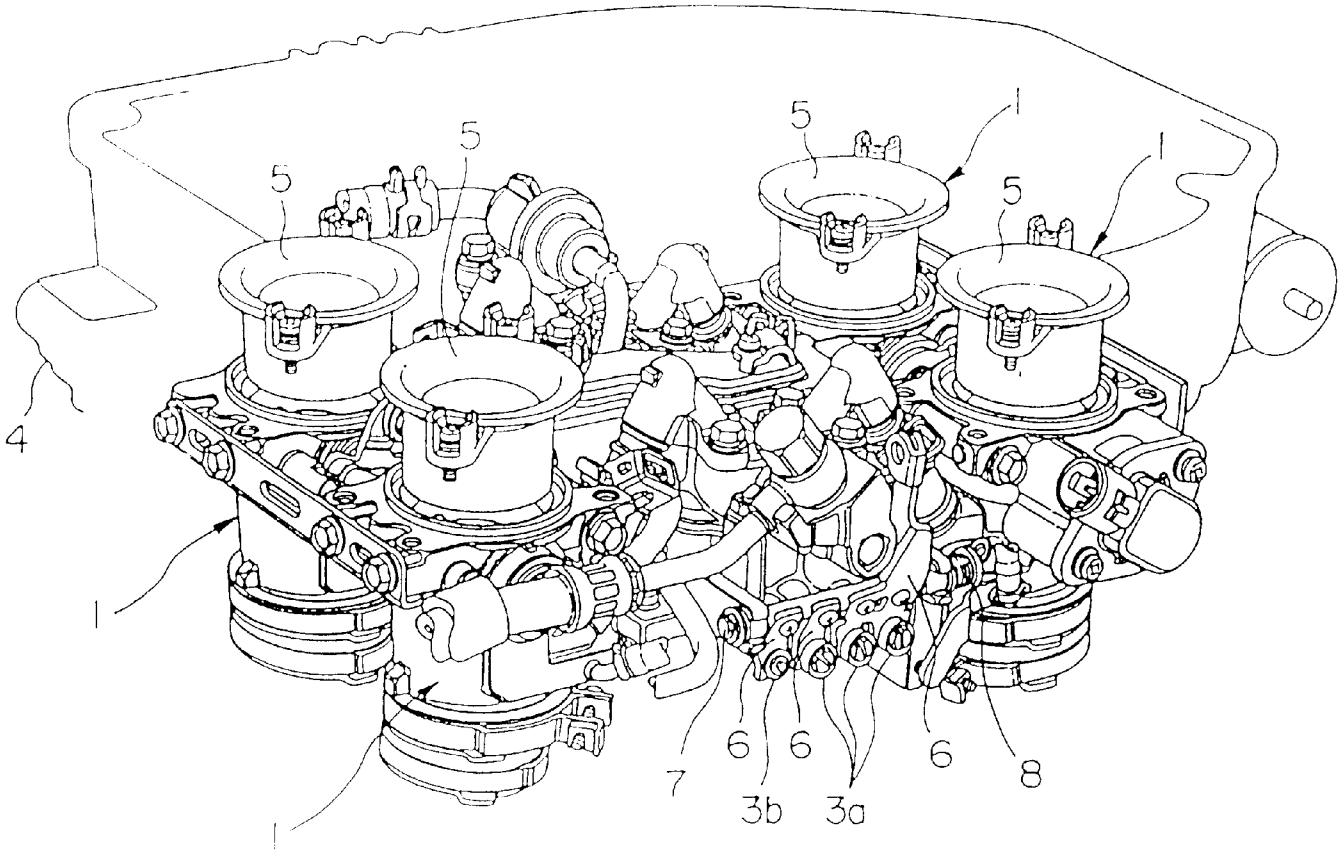
Fig. 6 Background Art
FIG. 6 is a perspective drawing of a throttle body of the related art provided with starter valves.
Figure 7:
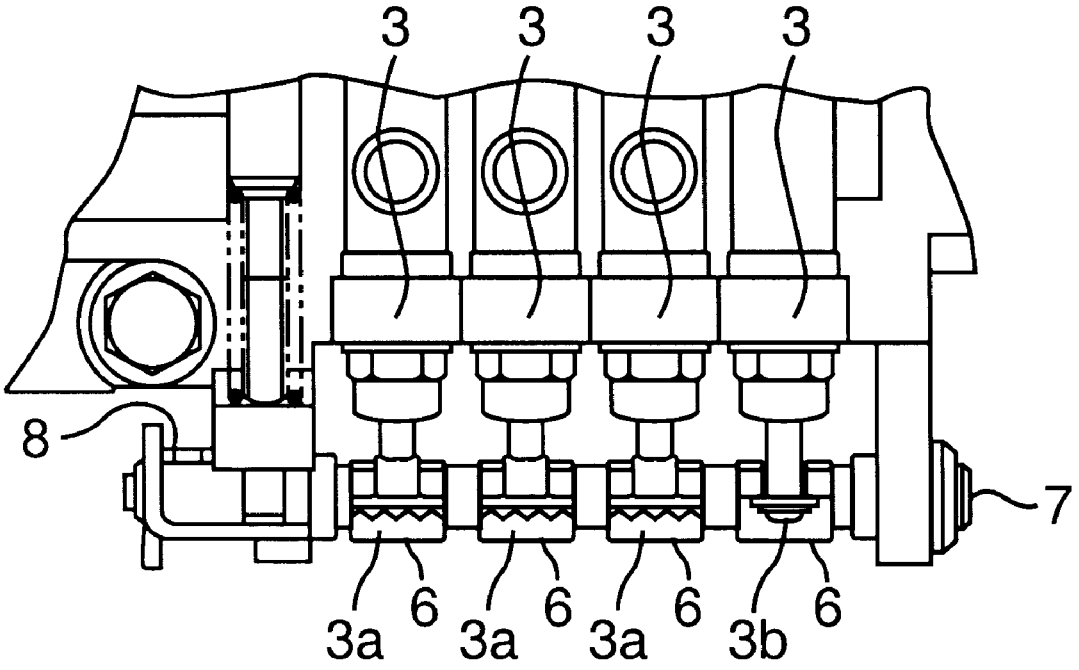
FIG 7 BACKGROUND ART
FIG. 7 is a rear view of a starter valve which illustrates the composition and structure of the starter valves provided in the throttle body of FIG. 6.

FIG. 5 shows a link 41 attached to the end of the shaft valve 26. Connected to this link 41 is a rod 42 of a displacement device 43 for moving the rod 42 in response to temperature variations. The displacement device 43 contains wax, which varies in volume in response to temperature variations, so the temperature of the wax varies depending on the temperature of coolant supplied from a radiator. Accordingly, the rod 42 is moved in response to variations in volume of the wax and the shaft valve 26 is rotated through the link 41.

In other words, when the displacement device 43 is provided, the shaft valve 26 is caused to rotate in response to variations in engine temperature, and it is therefore possible to vary the idling opening amount and intake when starting the engine.

In the above described starting control valve assembly 11, by making the diameter of the shaft valve 26 small, it is possible to make the clearance of the through holes small. This reduces sticking of the shaft valve 26 due to the intrusion of foreign matter etc. into the clearance holes.

According to the starting control valve assembly for a multiple throttle of the present invention, as described above, the following effects can be obtained.

According to the starting control valve assembly for a multiple throttle according to the first embodiment of the present invention, the structure is such that it allows the idle adjustment for each throttle and variation of intake at the time of starting to be carried out collectively using a single shaft valve. This is different than the structure of the related art, where a starter valve is provided for each cylinder and in order to cause each of the adjustment screws of these starter valves to move collectively, it is necessary to have a structure connecting the adjustment screws together. Therefore, it is possible to simplify the structure of the valve itself. Furthermore, there is no need for a connecting structure, which brings about a substantial reduction in the number of component parts and a drastic reduction in cost.

Also, since there is no competition for air supply between the cylinders when idling and starting air is supplied to the intake ports of each of the throttle bodies through the respective second flow paths, it is possible to ensure stable idling.

According to the starting control valve assembly for a multiple throttle according to the second embodiment of the present invention, since seal members are provided on both ends of the shaft valve sandwiching the second flow paths, it is possible to prevent the second flow paths from leaking.

According to the starting control valve assembly for a multiple throttle according to the third embodiment of the present invention, it is very easy to electrically control the engine idle opening amount and variation in intake when starting using a control motor connected to the end of the shaft valve.

According to the starting control valve assembly for a multiple throttle according to the fourth embodiment of the present invention, since a rod of a displacement device which is moved in response to temperature variation is connected to the end of the shaft valve through a link, the shaft valve is made to rotate in response to variations in engine temperature, and it is possible to vary the idling amount and intake when starting.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. In a multiple throttle having multiple throttle bodies with intake ports for introducing a mixture to each combustion chamber of a multiple cylinder engine, a starting control valve assembly for supplying air from an air cleaner to said intake ports via a bypass channel, comprising:

a plurality of valve bodies;

a plurality of supply paths, each having a first end connected to one of said plurality of valve bodies, and a second end adapted to be connected to one of the intake ports of the throttle bodies;

a connection path formed in each of said plurality of valve bodies, and adapted to be in communication with the air cleaner;

a first flow path and a second flow path formed in each of said plurality of valve bodies for connecting said connection path and said supply path of each of said plurality of valve bodies;

an adjustment screw provided in each said first flow path for adjusting an opening amount of each said first flow path; and a shaft valve rotatably mounted in through holes crossing adjacent of said second flow paths; and a plurality of idle connection holes formed in said shaft valve, one of said plurality of idle connection holes being in communication with one said second flow path, each of said idle connection holes extending in a same direction, and an opening amount of each said second flow path is adjusted in unison by rotating said shaft valve.

2. The starting control valve assembly according to claim 1, wherein seal members are provided on said shaft valve between each of said second flow paths, said seal members providing an airtight seal between adjacent of said second flow paths.

3. The starting control valve assembly according to claim 1, further comprising a control motor connected to said shaft valve for rotating said shaft valve.

4. The starting control valve assembly according to claim 2, further comprising a control motor connected to said shaft valve for rotating said shaft valve.

5. The starting control valve assembly according to claim 1, wherein a displacement device includes a rod connected thereto, said rod being connected to said shaft valve, and wherein said displacement device moves said rod in response to temperature variations to rotate said shaft valve.

6. The starting control valve assembly according to claim 2, wherein a displacement device includes a rod connected thereto, said rod being connected to said shaft valve, and wherein said displacement device moves said rod in response to temperature variations to rotate said shaft valve.

7. The starting control valve assembly according to claim 1, further comprising:

a lever provided on an end of said shaft valve and extending radially therefrom; and an idle screw adjustably mounted in one of said plurality of valve bodies, said idle screw contacting said lever for adjusting a rotation position of said shaft valve.

8. The starting control valve assembly according to claim 1, wherein each of said first flow paths includes a first path generally perpendicular to said connection path and a second path generally parallel to said connection path, each of said adjustment screws being in communication with each of said first paths, respectively.

9. The starting control valve assembly according to claim 8, wherein each of said second flow paths includes a first path generally perpendicular to said connection path and a second path generally parallel to said connection path, said shaft valve crossing each of said first paths.

10. A starting control valve assembly for supplying air from an air cleaner to an intake port of a multiple throttle, comprising: a valve body;

a supply path having a first end connected to said valve body and a second end adapted to be connected to the intake port of the multiple throttle body;

a connection path formed in said valve body, and adapted to be in communication with the air cleaner;

a first flow path and a second flow path formed in said valve body, each of said first and second flow paths connecting said connection path to said supply path;

an adjustment screw rotatably mounted in said valve body and in communication with said first flow path for adjusting an opening amount of said first flow path; and a shaft valve rotatably mounted in a through hole crossing said second flow path;

an idle connection hole formed through said shaft valve, said idle connection hole being in communication with said second flow path and extending in a same direction, and an opening amount of said second flow path is adjusted by rotating said shaft valve.

11. The starting control valve assembly according to claim 10, wherein seal members are provided on said shaft valve on each side of said second flow path, said seal members providing an airtight seal within said second flow path.

12. The starting control valve assembly according to claim 10, further comprising a control motor connected to said shaft valve for rotating said shaft valve.

13. The starting control valve assembly according to claim 11, further comprising a control motor connected to said shaft valve for rotating said shaft valve.

14. The starting control valve assembly for a multiple throttle as disclosed in claim 10, wherein a displacement device includes a rod connected thereto, said rod being connected to said shaft valve, and wherein said displacement device moves said rod in response to temperature variations to rotate said shaft valve.

15. The starting control valve assembly for a multiple throttle as disclosed in claim 11, wherein a displacement device includes a rod connected thereto, said rod being connected to said shaft valve, and wherein said displacement device moves said rod in response to temperature variations to rotate said shaft valve.

16. The starting control valve assembly according to claim 10, further comprising:

a lever provided on an end of said shaft valve and extending radially therefrom; and an idle screw adjustably mounted in said valve body, said idle screw contacting said lever for adjusting a rotation position of said shaft valve.

17. The starting control valve assembly according to claim 10, wherein each of said first flow paths includes a first path generally perpendicular to said connection path and a second path generally parallel to said connection path, each of said adjustment screws being in communication with each of said first paths, respectively.

18. The starting control valve assembly according to claim 17, wherein each of said second flow paths includes a first path generally perpendicular to said connection path and a second path generally parallel to said connection path, said shaft valve crossing each of said first paths.

* * * * *